United States Patent [19]

Yui

[11] Patent Number: 4,646,476

[45] Date of Patent: Mar. 3, 1987

[54] INTERNAL HOLE GRINDING SPINDLE

[76] Inventor: George M. Yui, 1543 Knareswood Drive, Mississauga, Ontario, Canada, L5H 2L9

[21] Appl. No.: 773,598

[22] Filed: Sep. 9, 1985

Related U.S. Application Data

[63] Continuation-in-part of Ser. No. 548,931, Nov. 7, 1983, abandoned.

[51] Int. Cl.[4] ..... B24B 41/04

[52] U.S. Cl. ..... 51/166 TS; 51/90; 51/261

[58] Field of Search ..... 51/166 TS, 267, 261, 51/90, 165.93

[56] References Cited

U.S. PATENT DOCUMENTS

| | | | |
|---|---|---|---|
| 844,265 | 2/1907 | Dorris | 51/261 |
| 1,260,080 | 3/1918 | Singer | 51/261 |
| 1,430,933 | 10/1922 | Brandt | 51/90 |
| 2,011,091 | 8/1935 | Steinbauer | 51/261 |
| 2,489,437 | 11/1949 | Sandoz | 51/267 |
| 2,621,452 | 12/1952 | Wells | 51/166 TS |

FOREIGN PATENT DOCUMENTS

| | | | |
|---|---|---|---|
| 676465 | 6/1939 | Fed. Rep. of Germany . | |
| 967816 | 12/1957 | Fed. Rep. of Germany . | |
| 593069 | 7/1925 | France | 51/261 |
| 374579 | 6/1932 | United Kingdom . | |

*Primary Examiner*—Harold D. Whitehead
*Attorney, Agent, or Firm*—Donald E. Hewson

[57] ABSTRACT

The disclosed apparatus provides rigid support for the grinding wheel by having the wheel shaft off center in the support housing. The one-piece housing can now have mass and bulk disposed in the plane of the contact force, for greater rigidity. The extra bulk provides room for a conduit internally in the housing to feed coolant to the wheel.

15 Claims, 4 Drawing Figures

INTERNAL HOLE GRINDING SPINDLE

RELATED APPLICATION DATA

This application is a continuation-in-part of application Ser. No. 548,931, filed Nov. 7, 1983, and now abandoned.

This invention relates to internal grinding.

In internal grinding, a grinding wheel is mounted on a shaft, and the shaft is supported in bearings in a housing. The surface finish of the ground hole depends, among other things, on how rigidly the shaft is mounted.

The wheel has to be held in contact with the internal surface of the hole with a certain amount of force. If that contact force is light, then the rate of stock removal is slow, and the wheel may become glazed, but at least the deflection of the shaft can be kept low. On the other hand, if the contact force is heavy, then the shaft may deflect an appreciable amount and, worse, the shaft may vibrate. Hence there is a compromise between pressing the wheel too strongly, so that the shaft deflects, or pressing it too lightly, so that production is slow.

The deeper the hole, the tighter this compromise becomes. The compromise can be eased by mounting the shaft more rigidly. It is an aim of the invention to enhance the rigidity with which the wheel is held against the surface of the hole.

PRIOR ART

For shallow holes, it is usually no problem to achieve the rigidity required. The shaft on which the wheel is mounted can be short and stubby enough to be rigid without any support at all, at least over that portion of the shaft that enters the hole. In this context, a shallow hole is one in which the depth of the hole is no more than about three times the diameter of the hole.

The problem of having to provide rigidity for the shaft starts to arise in holes having depths greater than three times the diameter. At these depths, an unsupported shaft becomes too flimsy, leading to the results mentioned above.

The following is a summary of some of the ways of supporting the shaft that are taught by the prior art.

In U.S. Pat. Nos. 1,260,080 (SINGER, Mar. 19, 1918) and 1,441,242 (ROBINSON, Jan. 09, 1923) the grinding wheel shaft is provided with a housing that carries a bearing for the shaft closely adjacent to the wheel. Thus the shaft is relieved of bending deflections, the bending deflections being taken now mainly by the housing.

In U.S. Pat. No. 1,430,933 (BRANDT, Oct. 03, 1922) is an example of using the hole itself to provide support for the grinding wheel. Here, the shaft is mounted in a housing which contacts the surface of the hole, diametrically opposite the point at which the wheel contacts the surface of the hole.

With this arrangement the support for the wheel is not so dependent on the cantilever stiffness of the housing, from its point of attachment outside the hole. Theoretically at least, very deep holes can be ground without undue loss of rigidity.

There are a number of problems with taking the support for the wheel from the hole itself. First, as the wheel wears, the machine operator must adjust the position of the wheel radially with respect to the housing. If he did not, as the wheel became worn, the wheel would not touch the surface of the hole. The need for constant compensation for wear is most demanding, and leads to the complexities as may be seen in BRANDT's disclosure. The possibility of inexact compensation is very great, since the wear of the wheel in the hole can only be estimated, not measured.

The second problem with taking the support from the hole is this. If the hole in the workpiece tends to be at all in error from the truly cylindrical, then such errors are faithfully repeated and amplified. The wheel is not pressed harder at a high spot, nor more lightly at a low spot. Such support produces a hole with the attribute that any diameter of the hole is the same length as every other diameter. (Or at least, the diameters would be all equal if the compensation for wear were exact enough.) Yet a hole can deviate appreciably from the truly round whilst still having equal diameters. The same applies to the cylindricity of the hole, in that the fact of equal diameters does not necessarily mean that the wall of the hole is straight, in an axial direction.

Furthermore, taking the support from the hole itself, as in BRANDT, does not correct any errors in the position of the hole in the workpiece. If the constancy of the wall thickness of the workpiece around the hole is important (as it usually is) then the wheel must be prevented from wandering off to one side, and a support system that just provides constant diameter would not tend to correct such an error. For very deep holes, the primary concern is to prevent the wheel from wandering.

Grinding machines are generally built to the highest degree of accuracy. To take full advantage of that accuracy the grinding wheel must be mounted rigidly with respect to the frame of the grinding machine.

For these reasons, supporting the wheel from the hole itself, though at first sight seeming to offer the possibility of grinding holes to great depths, in fact is an arrangement with such large disadvantages as to be unpracticable, at least when the cylindricity of the hole is important.

In U.S. Pat. No. 844,265 (DORRIS, Feb. 12, 1907) the support for the wheel is derived from the rigid resistance to bending of a housing, as was the case in SINGER to ROBINSON, and not from the hole itself as was the case in BRANDT.

All the above patents teach the use of eccentrics in the various manners shown. DORRIS shows how the shaft, and its bearings, may be adjusted eccentrically to compensate for wear of the wheel. Clearly, such a manner of adjustment cannot be used unless the shaft is very small in relation to the size of the housing, because a great deal of radial space is occupied by presence of the adjustment mechanism.

BRANDT too shows an eccentric for adjusting the wheel radially outwards to compensate for wear.

SINGER and ROBINSON on the other hand show eccentrics for rotating the housing and the shaft together for the purpose of causing the wheel to traverse in a circle around the internal surface of the hole in the workpiece.

DESCRIPTION OF THE INVENTION

In the invention, the housing is formed from a single piece of material. No assembly of separate pieces of material can be as rigid as a single piece that occupies the same space. Apart from the shaft and its bearings, no other force supporting structure enters the hole apart from the housing. The housing is clear of the hole: a clear space exists between the housing and the hole in the workpiece. Coolant and grinding debris may occupy this space, as will be described below, but no rigidity-enhancing structure occupies the space.

Hence, the support for the wheel comes only from the inherent rigidity of the housing and its manner of attachment outside the hole.

In the invention, the shaft is journalled to the housing by a bearing that is close to the wheel. The aim of this is to keep the shaft as free from bending as practicable.

In the invention, the wall thickness of the housing varies at different orientations. The thinnest wall thickness is so small that the wheel protrudes radially (i.e., when viewed axially) beyond the wall at the orientation of the thinnest wall thickness. The wheel cound not of course grind the surface of the hole if it did not protrude beyond the housing. The wheel is substantially smaller in diameter than the hole in the workpiece: even when the wheel is new and un-worn, the wheel can have a diameter hardly more than three-quarters the diameter of the hole.

The thickest wall thickness is so great that the housing at that orientation does protrude beyond the wheel.

In the invention, it has been recognized that there is room for the housing to have more bulk than has been the case in the prior art, and it has been recognized that the bulk that can be added in that room is effective to increase the thickness of the housing in the same plane as that containing the line of action of the contact force between the wheel and the surface of the hole. In other words, there is room for bulk to be added right where that bulk is the most effective to increase the stiffness of the housing.

In summary, then, the invention lies in providing a housing which has the following attributes:

(a) it is made from a single piece of material;
(b) it accommodates a bearing close to the grinding wheel;
(c) the bearing is solidly mounted in the housing: the bearing is not movable or adjustable;
(d) its maximum wall thickness is such that the housing protrudes radially beyond the wheel;
(e) it takes no support from the hole;

All these measures are taken for the purpose of achieving rigidity without comprising other aspects of the grinding process, and for the purpose of grinding deep holes in a convenient and economical manner.

FURTHER DETAILS OF THE INVENTION

There are a number of optional features which are advantageous, as recognized in the invention.

For the purpose of traversing the wheel around the hole, either the workpiece may be rotated, or the wheel and housing assembly may be rotated. The choice is not normally available to the user of the grinding machine, but is built into the machine. The invention is preferred for use in those grinding machines where the workpiece is the one that rotates. The reason for the preference is that the housing, being fixed, can be solidly built into the frame of the machine, which goes towards making the housing more rigid. Another benefit of having the housing stationary is that coolant can be fed to the wheel very easily. It might be possible to feed coolant through or around a rotating housing, but not without complexity.

The axis of the shaft, and of the wheel, need not be parallel to the axis of the hole in the workpiece. However, the apparatus is easier to make when the shaft is so parallel.

The wheel has to be adjusted radially with respect to the hole that is being ground, not only to grind off the next layer of metal, but also to compensate for wear of the wheel. This feed movement might be provided by moving the shaft at an angle to the housing; but preferably the shaft and the housing remain parallel to each other, and to the hole, and move bodily together during feed adjustment movement. This latter arrangement is the simplest to construct, and gives the most rigid support to the wheel.

Similarly, it is preferred for the wall thickness of the housing at a given orientation to be the same all along the length of the housing (or at least along all the portion of the length of the housing that enters the hole).

Preferably, for ease of construction, the outside surface of the housing is a right cylinder, and the shaft (and bearing) is then accommodated in a through-hole formed eccentrically in the housing. It is possible to make the housing to a different shape which is slightly better, from the rigidity point of view, then a cylindrical shape. This will be described later.

In addition to the bearing that is near to the wheel, it is preferred to have many bearings between the shaft and the housing at intervals along the length of the housing. This reduces vibration in the high-speed shaft. Preferably too, a means is provided for isolating the shaft from any vibrations that tend to deflect that shaft in bending.

The housing can have the most bulk when the thinnest wall thickness is at the orientation where the grinding wheel touches the workpiece, and the thickest wall thickness is at the diametrically opposite orientation. As to the shape of the housing, the aim is that the space available to accommodate the bulk of the housing should be filled to the maximum extent, leaving just a small margin of space between the housing and the hole.

The provision of adequate supplies of coolant is important in any grinding operation. In the invention, as mentioned above, the aim is to fill the hole to be ground with the bulk of the material of the housing, and this could pose difficulties in the area of coolant supply. However, in the invention, the coolant is preferably conducted along the housing through a conduit formed in the material of the housing. Such a conduit can be formed in the material of the housing at a place near the neutral axis of the housing where the removal of material for the conduit has hardly any effect on the rigidity of the housing. Preferably also, the coolant is caused to jet out axially from the end of the housing directly onto the wheel. Incoming coolant forces waste coolant and grinding debris out through the space between the housing and the hole.

Using the apparatus of the invention, holes can be ground to a depth of 10 or even 12 times their diameter. The housing support as described is suitable for blind holes: if the hole extends through the workpiece, then it is possible to support the wheel on two housings, one either side, axially, of the wheel, and thus to grind through-holes that have a length of 20 or 24 times their diameter.

A preferred embodiment of the invention will now be described, with reference to the accompanying drawings.

IN THE DRAWINGS

Figure 4:
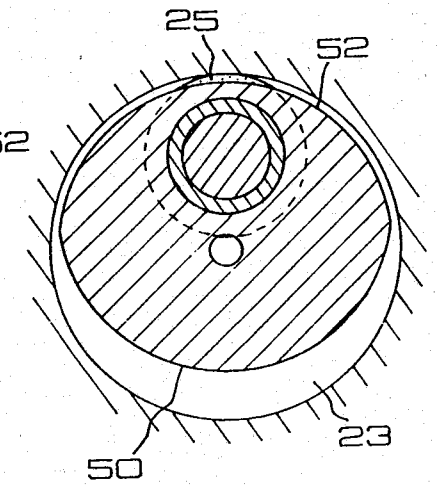
Figure 3:
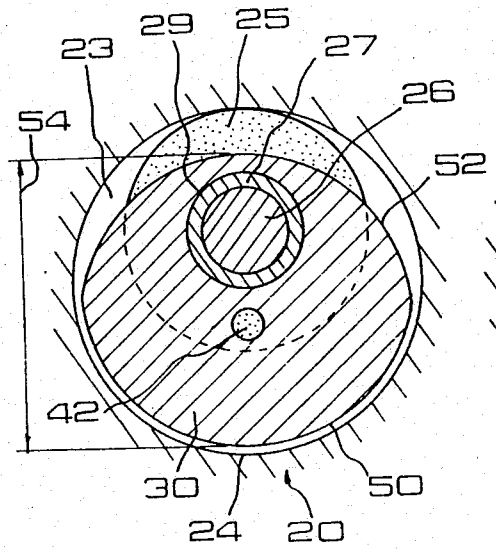
FIG. 3 is a cross-section corresponding to FIG. 2 showing a modified housing, when the wheel is new.

FIG. 4 corresponds to FIG. 3, when the wheel is worn.

Figure 1:
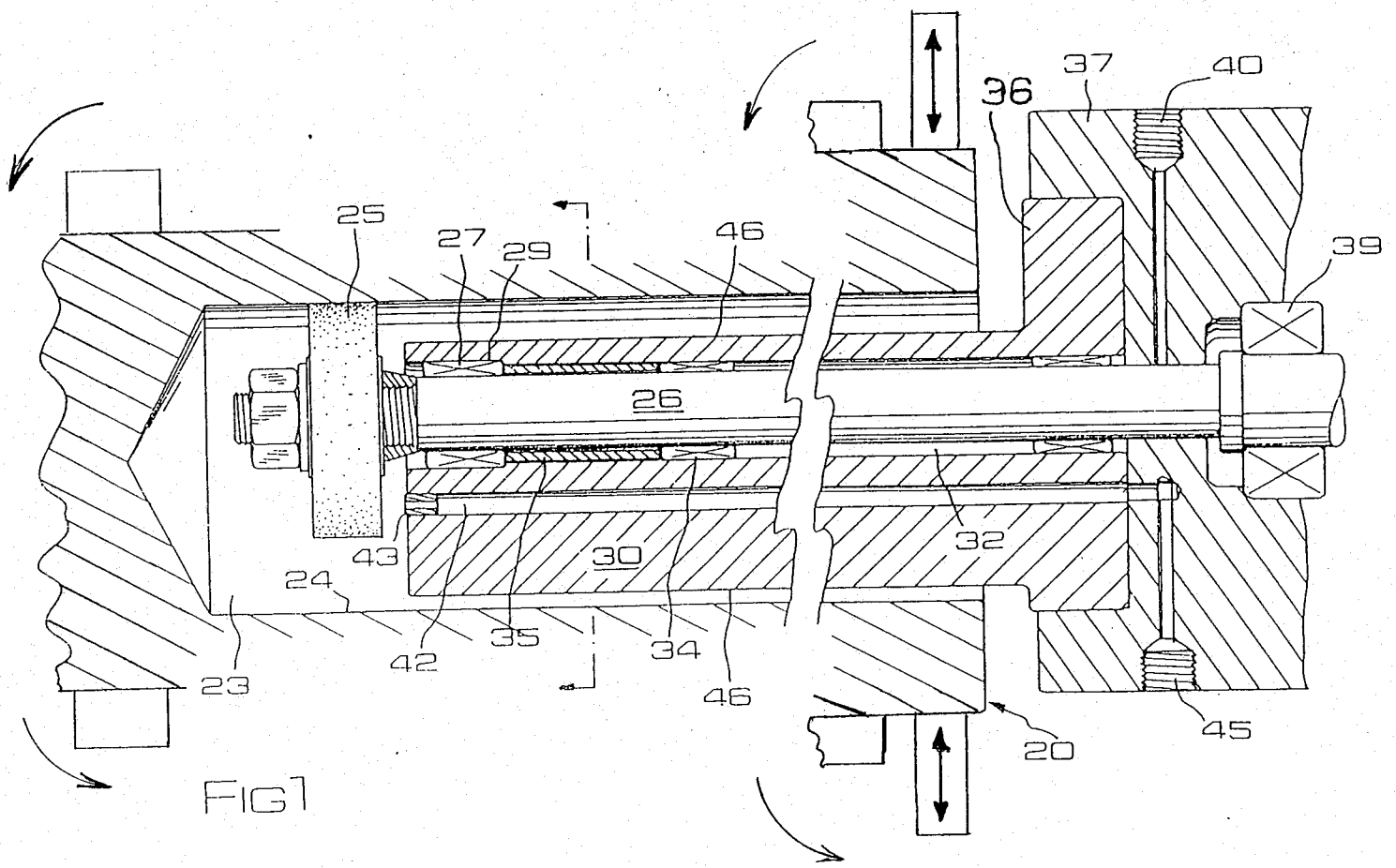
FIG. 1 is a cross-section of an apparatus for grinding a deep hole in a workpiece when the grinding wheel is new.

In FIG. 1, the workpiece 20 has a long deep hole 23 having an inward facing surface 24, which is to be finished by grinding.

A grinding wheel 25 is fixed securely to a grinding wheel shaft 26, which is rotated at high speed.

An end bearing 27 locates the shaft 26 near the wheel 25. The bearing fits into a bearing-hole 29 formed in a housing 30.

The housing 30 is provided with a shaft-hole 32 which is co-axial with the bearing hole 29. Further bearings 34 are provided at intervals along the shaft-hole 32. The bearings 34 are separted by spacers 35.

The housing 30 has a flange 36 by which it is fixed firmly to the frame 37 of a grinding machine. The shaft 26 is guided in yet more bearings 39 in the frame 37, in the manner conventional to grinding machines. The bearings 27,34 need to be radially slim since they are passed inside the hole 23, but the bearing 39 has no such requirement for radial slimness. The bearings 34,27 may be plain bearings, or they may be needle roller bearings. A supply of lubricant is fed in through a port 40, and is conducted along the shaft to the bearings 37,34,39.

A coolant conduit 42 was drilled through the housing 30. A bushing 43 causes coolant to issue in a jet directly onto the wheel 25. Coolant is fed in through the port 45.

Figure 2:
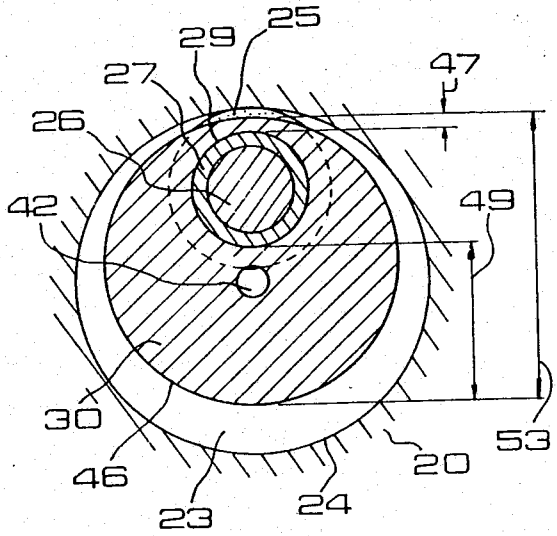
FIG. 2 is cross-section on the section line in FIG. 1, when the grinding wheel is worn.

The housing is formed from a single piece of material. The flange 36 is round and is concentric with the shaft hole 32. As shown in FIG. 2 the outside surface 46 of the housing 30 is a right cylinder, formed eccentrically of the shaft hole 32.

The minimum wall thickness 47 of the housing 30 does not protrude radially beyond the wheel 25, but the maximum wall thickness 49 does.

The outside surface 46 of the housing 30 takes no support from the surface 24 of the hole 23. There is a marginal space all round, between the housing 30 and the hole 23.

In FIGS. 3 and 4, the outside surface 46 of the housing 30 is not cylindrical, but is lemon-shaped, i.e., it has the shape of a right cylinder from which a central slice has been removed. When the wheel is new, as in FIG. 3, the surface 50 is marginally clear of the hole 23, and when the wheel is worn, the surface 52 is the one that is marginally clear of the hole 23.

The lemon-shape shown in FIGS. 3 and 4 is the maximum that the housing can have, and that shape therefore represents the most bulky, and hence the most rigid, housing. The shape is clearly much more difficult to make than a right cylinder. However, here is an appreciable gain in rigidity to be had from the lemon shape.

If the housing is cylindrical, the diameter 53 of the right cylinder should be no less than the dimension 54 shown in FIG. 3.

The grinding machine includes a conventional means for rotating the workpiece 20 about the axis of the hole 23. The machine includes also a conventional means for feeding the workpiece 20 axially with respect to the wheel 25 along the length of the hole 23. And the machine includes also a conventional means for feeding the wheel 25 radially in and out with respect to the hole 23.

I claim:

1. Grinding apparatus, for use in combination with a workpiece having a deep cylindrical hole;

where the apparatus is characterized by the following combination of structural features:

a grinding wheel, mounted on a shaft for high speed rotation; which grinding wheel has a first, larger diameter when new and unworn, and a second, smaller, diameter when fully worn;

a unitary housing which consists of a single piece of material having an axially directed hole to accommodate the shaft;

a bearing between the shaft and the unitary housing;

where the bearing is placed, as to its axial location, closely adjacent to the grinding wheel;

where the axis of the shaft is fixed with respect to said unitary housing, in a radial direction;

where said single piece of material which constitutes said unitary housing has a wall thickness, measured radially from the periphery of the shaft hole to the outside surface of the piece, which is different at different orientations around the shaft;

where the thinnest wall thickness of said unitary housing is so thin at a first orientation that the outside surface of said housing at that first orientation protrudes radially a distance, measured from the axis of the shaft, which is less than said second, smaller, diameter of a fully worn grinding wheel;

where the thickest wall thickness of said unitary housing is so thick at a second orientation that the outside surface of said housing at that second orientation protrudes radially a distance, measured from the axis of the shaft, which is greater than said first, larger, diameter of a new grinding wheel;

where said unitary housing is so dimensioned as to be long enough and thin enough that the grinding wheel can be entered into a cylindrical hole in a workpiece to a depth of at least three times the diameter of that hole; and where, when the grinding wheel is entered in a hole in a workpiece to said depth, the outside surface of said unitary housing is spaced from the inward-facing surface of said hole in a workpiece;

so that said housing is supported entirely from outside a hole in a workpiece into which it has been inserted.

2. Apparatus of claim 1, where, when said unitary housing is entered into cylindrical a hole in a workpiece, the axis of said shaft is parallel to the axis of said cylindrical hole.

3. Apparatus of claim 2, having means for providing a feed adjustment of a workpiece into which said unitary housing has been inserted, where said workpiece is adjusted in a radial direction relative to said grinding wheel; and where the axis of said shaft moves bodily relative to, and remains parallel to, the axis of said cylindrical hole in a workpiece hole during said radial feed adjustment.

4. Apparatus of claim 1, having means for rotating a workpiece into a cylindrical hole of which said unitary housing has been inserted, where said workpiece is rotated about the axis of said cylindrical hole;

and having a further means for fixing said unitary housing against rotation about said axis of said cylindrical hole.

5. Apparatus of claim 1, where the radial wall thickness of said unitary housing at any given radial orientation around said shaft is substantially constant along at least that portion of the axial length of said unitary housing that may be inserted within a cylindrical hole of a workpiece.

6. Apparatus of claim 5, where the outside surface of said unitary housing is cylindrical.

7. Apparatus of claim 5, where the outside surface of said unitary housing is lemon shaped in that said surface is a composite of two cylindrical surfaces, each of those surfaces having a radius marginally less than that of a cylindrical hole in a workpiece into which said unitary housing may be inserted;

where, at a first radial orientation of said unitary housing at its thinnest wall thickness, the overall thickness of said unitary housing from one outside point thereof to the outside point diametrically opposed thereto is the minimum overall thickness; and where the overall thickness of said unitary housing, measured at right angles to said first radial orientation, is the maximum overall thickness.

8. Apparatus of claim 1, having further bearings between said shaft and said unitary housing, which are located at intervals along the axial length of said unitary housing.

9. Apparatus of claim 1, having a drive means for rotating said shaft, and having further means to isolate said shaft from vibrations in said drive means.

10. Aparatus of claim 1, where the orientation of the thinnest wall thickness of said unitary housing coincides with the orientation at which said grinding wheel touches the inside facing surface of a cylindrical hole in a workpiece into which said unitary housing may be inserted.

11. Apparatus of claim 10, where the orientation of the thickest wall thickness of said unitary housing is opposite that of said thinnest wall thickness.

12. Apparatus of claim 1, further including means for conveying coolant to said grinding wheel.

13. Apparatus of claim 12, where said means for conveying coolant to said grinding wheel comprises an axially extending conduit formed in said unitary housing.

14. Apparatus of claim 13, where the orientation of said conduit in said unitary housing coincides with the orientation of the thickest wall thickness thereof.

15. Apparatus of claim 13, having further means for causing coolant to issue in a jet from said conduit, where said jet is axially directly onto said grinding wheel.

* * * * *